United States Patent [19]

Noble

[11] Patent Number: 4,628,984

[45] Date of Patent: Dec. 16, 1986

[54] METHOD AND APPARATUS FOR APPLYING A LAYER OF MATERIAL TO A CENTRIFUGAL CASTING MOLD

[76] Inventor: Charles H. Noble, 2307 Manassas Dr., Birmingham, Ala. 35213

[21] Appl. No.: 802,440

[22] Filed: Nov. 27, 1985

[51] Int. Cl.[4] ..... B22C 13/00

[52] U.S. Cl. ..... 164/33; 164/114; 164/286; 164/298; 222/365

[58] Field of Search ..... 164/33, 412, 298–301, 164/114, 175, 176–179, 286; 222/410, 411, 365

[56] References Cited

U.S. PATENT DOCUMENTS 4,124,056 11/1978 Noble ..... 164/33 X

*Primary Examiner*—Kuang Y. Lin

*Attorney, Agent, or Firm*—Roylance, Abrams, Berdo & Goodman

[57] ABSTRACT

Method and apparatus for establishing a layer of particulate material on at least a portion of the internal surface of a centrifugal casting mold by confining a quantity of the particulate material in a cavity, inserting the cavity into the mold, rotating the mold and the cavity at substantially the same rate adequate to apply substantial centrifugal force to the particulate material in the cavity, and opening the cavity to release the particulate material while continuing to rotate the mold and the cavity.

26 Claims, 17 Drawing Figures

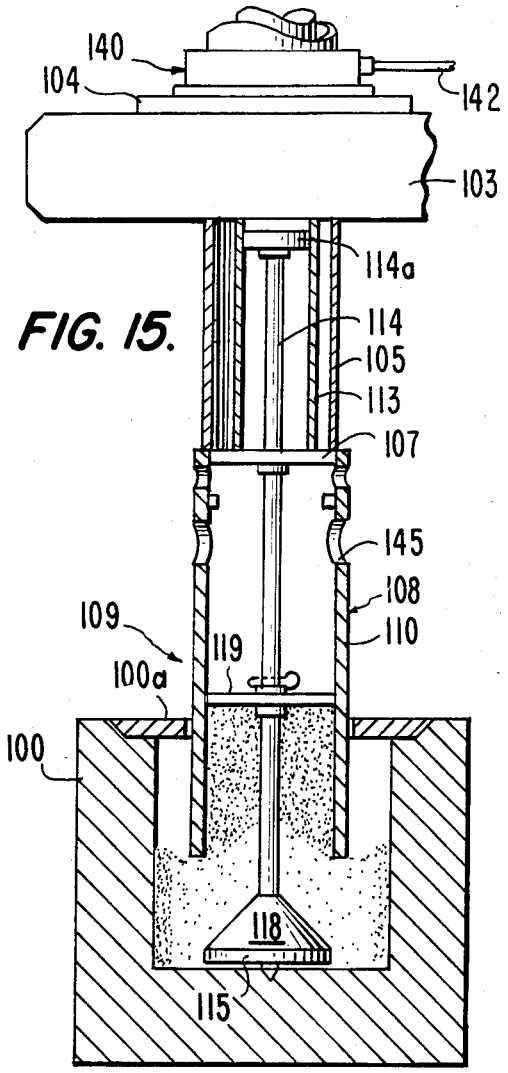
FIG. 15.
FIG. 16.
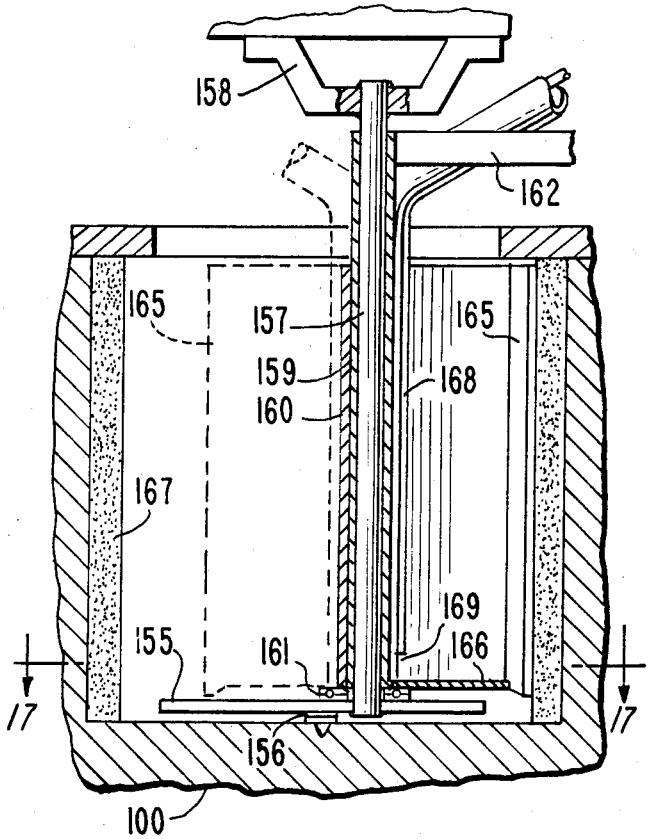
FIG. 17.
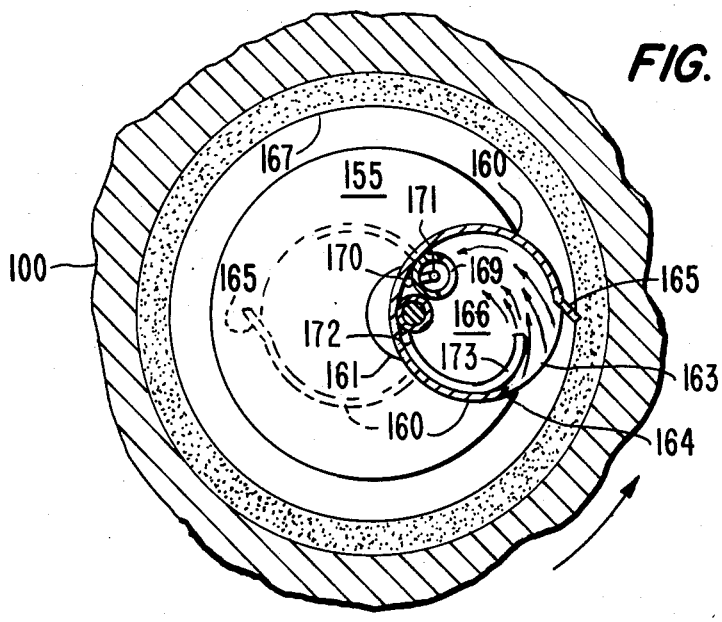

METHOD AND APPARATUS FOR APPLYING A LAYER OF MATERIAL TO A CENTRIFUGAL CASTING MOLD

RELATED APPLICATION

This application is a continuation-in-part of my copending application Ser. No. 534,610, filed Sept. 22, 1983 and now abandoned.

The invention provides a method and apparatus for applying to a centrifugal casting mold a layer of particulate material with the layer being in the form of a ring covering only a portion of the length of the mold surface or in the form of a continuous layer over the entire surface.

BACKGROUND OF THE INVENTION

In production of tubular metal articles by centrifugal casting in a metal mold which has an inner or active surface which is circular in cross section transverse to the axis of mold rotation, it is desirable to apply to the active surface of the mold a layer or layers of particulate material, with the layer ranging from a relatively narrow ring, as in the case of an end ring or an internal ring, to a layer completely covering the mold surface. In the case of an end ring, the ring simply serves to retain the molten metal being cast within the mold. In the case of an internal ring, the ring may serve as a portion of the surface against which the metal is to be cast, or may act to separate two castings made simultaneously in the mold. A layer covering the entire active surface of the mold constitutes the surface against which the molten metal is cast. In many prior-art practices, end rings for centrifugal casting molds have been in the form of preformed hardened refractory cores backed up by metal rings, and internal rings have been in the form of preformed refractory cores only. Layers covering the entire active surface of the mold have usually been of refractory material applied in various fashions.

While such rings and layers of various types are commonly employed in the centrifugal casting industry, there has been a need for a simple method for establishing such layers from particulate material, and for a simple and inexpensive apparatus for accomplishing such a method.

SUMMARY OF THE INVENTION

According to method embodiments of the invention, a layer of dry particulate material, especially refractory material, is established on at least a portion of the active surface of a rotatable centrifugal casting mold by confining the particulate material in a closed cavity with the particulate material in such condition as to be projectable by centrifugal force when the cavity is opened; rotating the mold at a rate adequate to densify the layer when the layer has been established; introducing the cavity into the mold and rotating the cavity at a rate adequate to apply a substantial centrifugal force to the particulate material confined in the cavity; while continuing to rotate the mold and cavity at such rates, progressively opening the cavity to release the particulate material centrifugally from the cavity with the centrifugal force then applying the released particulate material to the active surface of the mold in the form of the layer; and then withdrawing the cavity from the mold.

Apparatus embodiments of the invention comprise inner and outer members capable of coacting to define the cavity for retaining the particulate material, at least one of the inner and outer members comprising means engageable with the mold to cause the cavity to rotate with the mold; the outer and inner members being so constructed and interelated that at least one thereof can be moved axially relative to the other in order to progressively open the cavity when the mold and cavity are rotating; and means for accompanying such relative axial movement.

Though the method is best practiced with a finely particulate refractory material which is free from any binder, other particulate materials can be employed, including refractory materials including a initially dry setable binder.

IDENTIFICATION OF THE DRAWINGS

Figures 1, 2, 3, 4, 5:
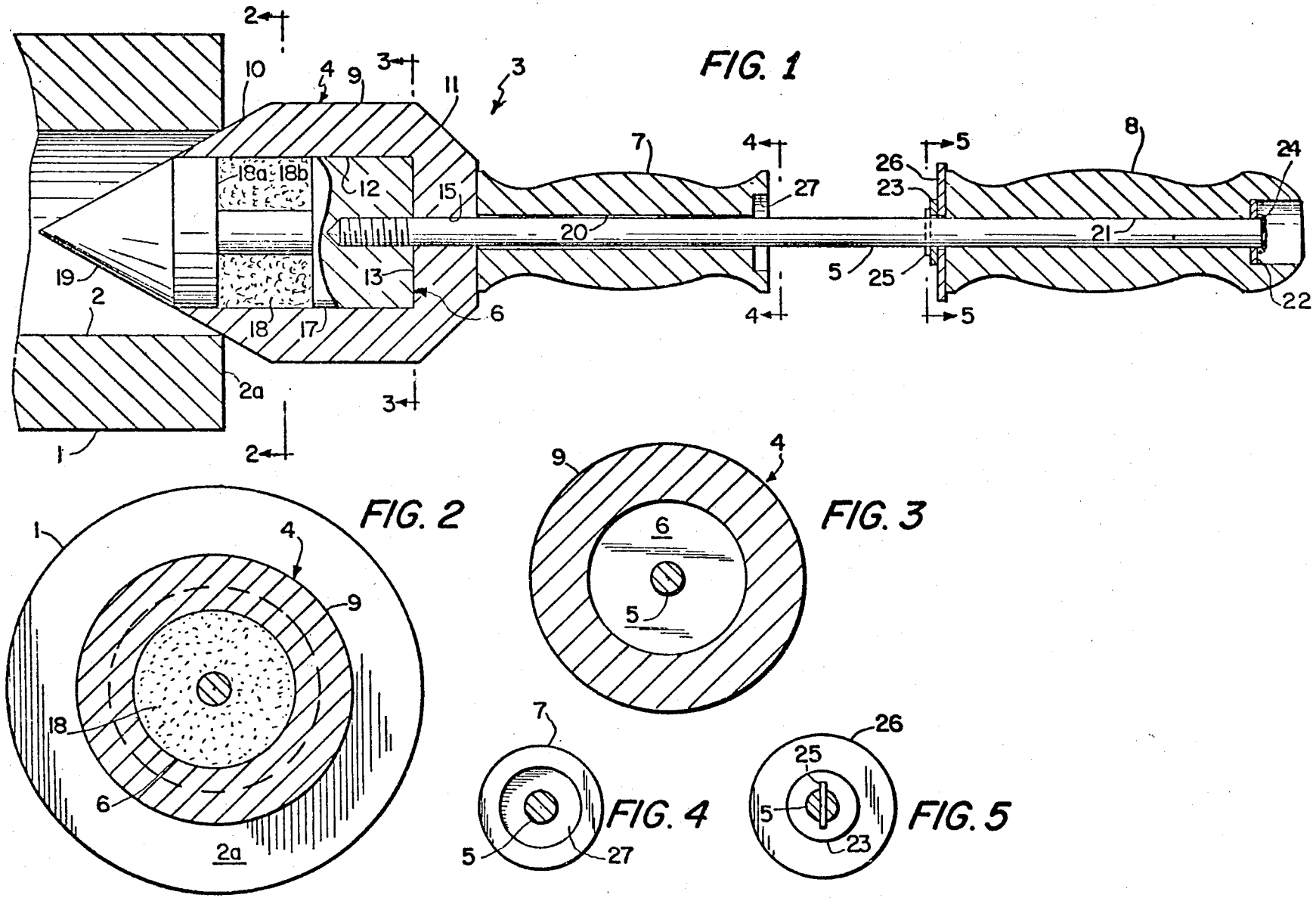
FIG. 1 is a longitudinal cross-sectional view of a tool according to one embodiment of the invention, with some parts shown in elevation, showing the tool fitted to the end of a rotating horizontal centrifugal casting mold, with parts in relative positions preliminary to establishment of an end ring in the mold.
FIGS. 2–5 are transverse cross-sectional views taken generally on lines 2—2, 3—3, 4—4 and 5—5, FIG. 1, respectively.
Figure 12:
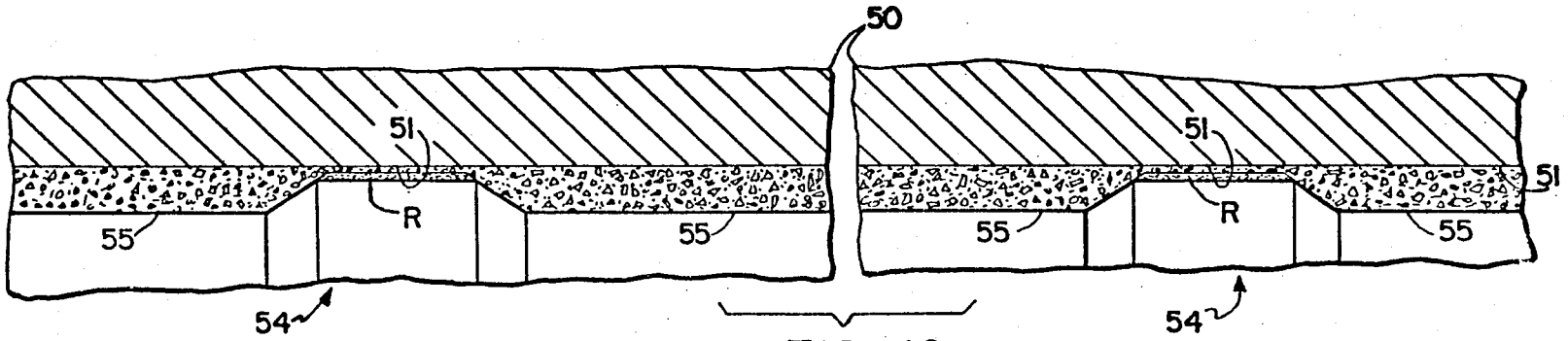
Figure 9:
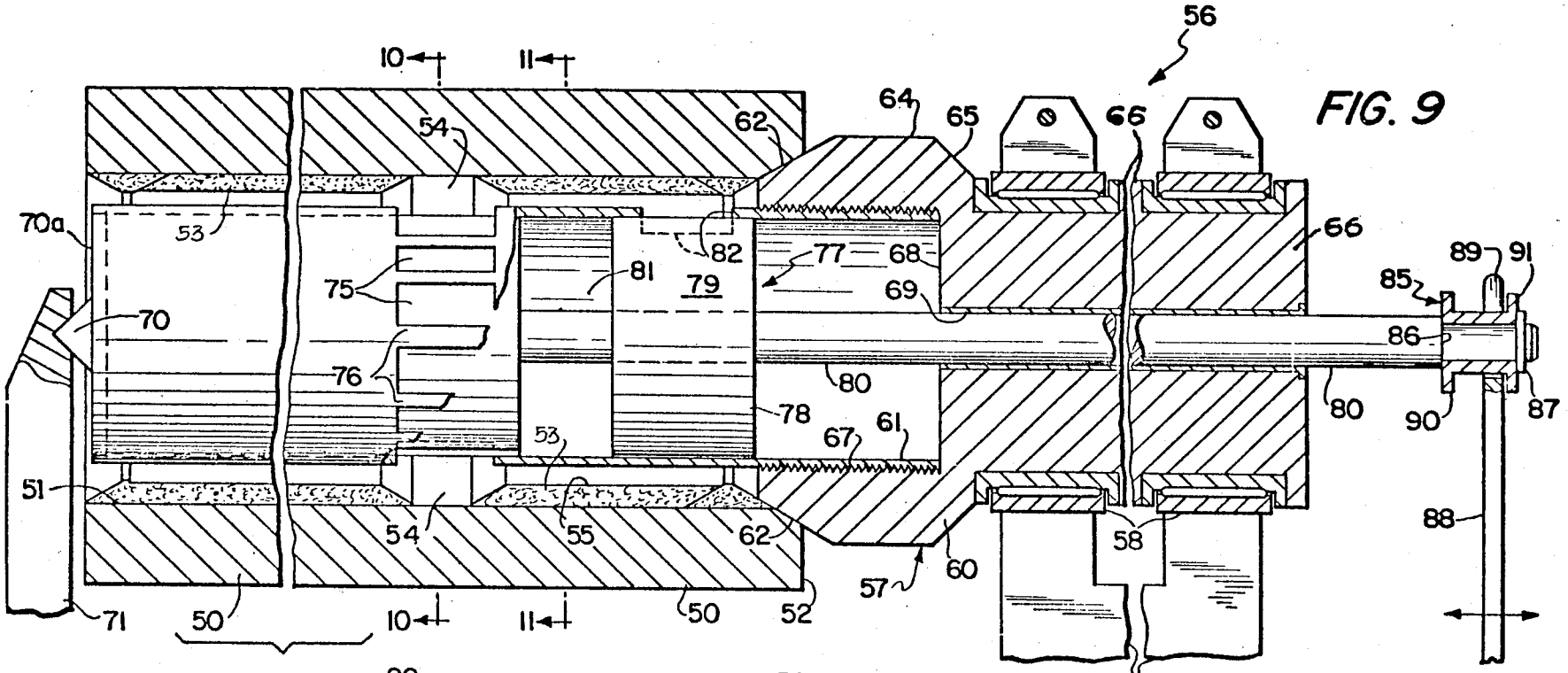
FIG. 9 is a view similar to FIG. 1 illustrating an embodiment of the tool for establishing a plurality of rings of particulate material within a metal mold.
Figure 11:
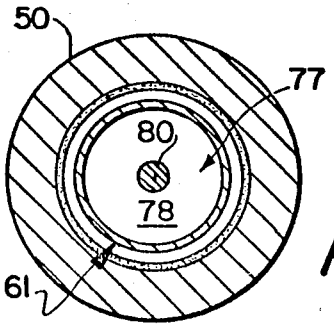
Figure 10:
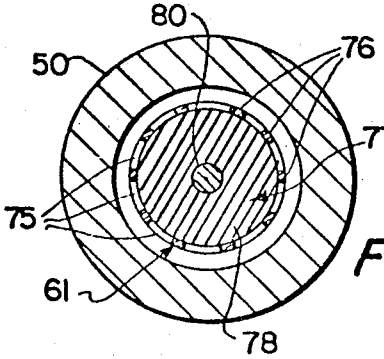
Figures 13, 14:
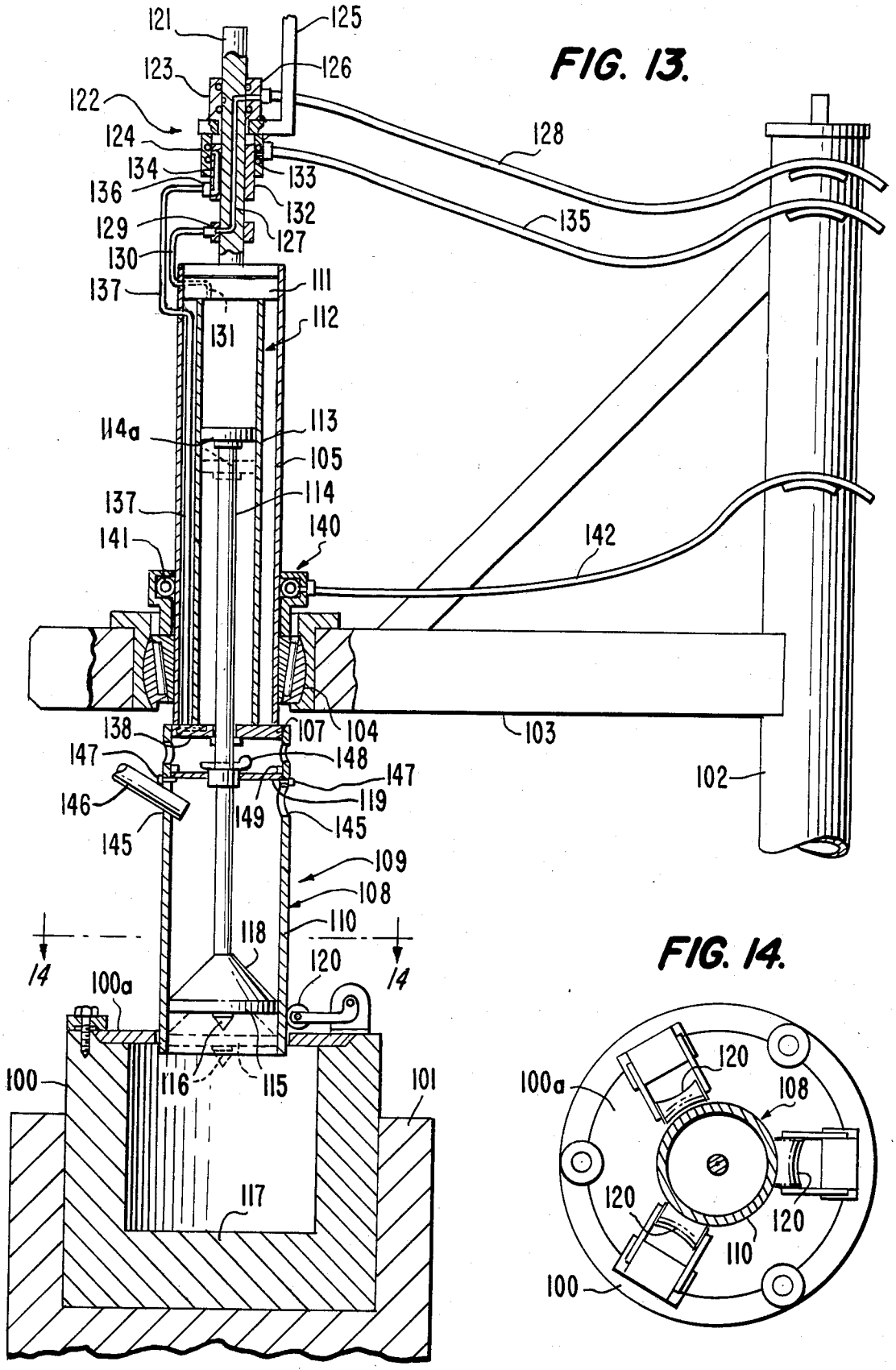

FIGS. 10 and 11 are transverse cross-sectional views taken generally on lines 10—10 and 11—11, FIG. 1, respectively, and reduced in scale relative to FIG. 9;

FIG. 12 is a fragmentary cross-sectional view illustrating one of the rings formed by the tool of FIGS. 9–11;

FIG. 13 is a view, partly in side elevation and partly in vertical cross section, of an apparatus for applying in lining to the active surface of a vertical mold, the cavity being shown raised above the mold preparatory to being filled with particulate material;

FIG. 14 is a transverse cross-sectional view taken generally on line 14—14, FIG. 13;

FIG. 15 is a semidiagrammatic view showing portions of the apparatus of FIG. 13 when lining of the mold is partially complete;

FIG. 16 is a vertical cross-sectional view showing a device for contouring the lining established by the apparatus of FIG. 13; and FIG. 17 is a transverse cross-sectional view taken generally on line 17—17, FIG. 16.

DETAILED DESCRIPTION OF THE INVENTION

Tool Of FIGS. 1–8

FIGS. 1–8 illustrate a manually manipualted tool for establishing end rings in a metal centrifugal casting mold according to one embodiment of the invention.

The metal mold 1 can be any mold of the type having an inner or active surface 2 which is of circular transverse cross section, the mold being mounted on a conventional mold supporting and rotating device such, e.g., as that shown and described in U.S. Pat. No. 4,124,056, so that the mold is supported in substantially horizontal position and rotated at controlled rates about its longitudinal axis. Tool 3 comprises a rotor 4, a shaft 5, a carrier member or spool 6 and a pair of handle members 7 and 8 carried by shaft 5, handle member 8 being restrained against axial movement between the shaft and handle member, handle member 7 being supported by the shaft but with complete freedom of axial and rotational movement of the shaft relative to the handle member.

Rotor 4 is an integral rigid body having a right circular outer surface portion 9, a forwardly and inwardly tapering frustoconical outer surface portion 10 extending from portion 9 to the forward end of the rotor, and a rearwardly and inwardly tapering frustoconical outer surface portion 11 extending from portion 9 to the trailing end of the rotor. Rotor 4 has an elongated right circular cylindrical inner surface 12 which extends from its intersection with surface portion 10 to a transverse rear wall 13, so that surface 12 and the front surface of wall 13 define a forwardly opening internal cavity 14, FIG. 6. Wall 13 has a right circular cylindrical through bore 15, surface portion 10, surface 12 and bore 15 being coaxial and rotor 4 being rotationally balanced with respect to the common axis. Shaft 5 extends through bore 15, the outer surface of the shaft being right circular cylindrical and of a diameter such that the shaft is free for rectilinear movement relative to rotor 4. As shown, one end portion of shaft 5 projects into cavity 14 while the other end of the shaft is spaced from wall 13 of the rotor.

Carrier member 6 is rigidly secured to the end portion of shaft 5 which projects into cavity 14. The carrier member has a right circular cylindrical outer surface 17 coaxial with the shaft and of a diameter such that member 6 is slidably embraced by surface 12. Outer surface 17 is interrupted by a transverse annular outwardly opening groove 18 defined by transverse walls **18*a* and 18*b*. Forwardly of groove 18, outer surface 17 joins the outer surface of a forwardly and inwardly tapering conical tip 19**.

Handle member 7 has an axial through bore 20 of a diameter such that shaft 5 extends freely therethrough. Handle member 8 is carried by the end portion of the shaft and has a through bore 21 of a diameter such that shaft 5 can rotate freely relative to the handle member. Substantial relative axial movement between handle member 8 and shaft 5 is prevented by spaced washers 22 and 23 which are secured against axial movement away from each other relative to the shaft. Thus, washer 22 can be welded at 24 to the corresponding end of shaft 5 and washer 23 can be restrained by a cross pin 25 rigidly fixed in a diametrical bore in the shaft on the side of the washer opposite handle member 8. A free washer 26 is provided between washer 23 and the adjacent end of handle member 8. The end of handle member 7 which is nearer member 8 is provided with an annular recess 27 to accommodate washer 23 and pin 25 when the two handle members are forced together endwise.

Groove 18 defines an annular space of a volume adequate to contain the amount of particulate refractory material required for the refractory ring to be made. With carrier member 6 extended forwardly, by manipulation of handle member 8, so that groove 18 is completely out of cavity 14, groove 18 can be filled with particulate material simply by forcing tip 19 downwardly into a mass of the particulate material until surface 10 of rotor 4 is also within the mass of particulate material and then, while holding handle member 7 stationary, pulling handle member 8 upwardly until carrier member 6 is fully housed in cavity 14 with surface 12 closing groove 18, and then withdrawing the tool upwardly.

Practice Of The Method With The Tool Of FIGS. 1–8

Groove 18 is first filled with a particulate material which is finely divided, dry and has characteristics suitable for the ring to be formed. Advantageously, the particulate material is a refractory material and can consist of one finely particulate refractory material, or a mixture of more than one material, with the total material exhibiting an angle of repose of at least 10° and with the particle size distribution being such that not more than 50% by weight of the particles have a maximum dimension greater than 150 microns and at least 20% by weight, advantageously 100%, are angular particles, the melting point of the material of all of the particles being significantly higher than the temperature of the molten metal to be cast in the mold. With carrier 6 withdrawn completely into cavity 14, so that the space defined by groove 18 is closed against escape of particles, the operator grasps handle member 7 in one hand, aligns tool 3 axially with an end of metal mold 1, and advances the tool toward the mold until the frontal frustoconical surface portion 10 of rotor 4 is firmly engaged with the annular corner defined by surfaces 2 and **2*a* of the metal mold. This step is advantageously carried out after rotation of mold 1 has been commenced, typically at 200–500 r.p.m., with the result that rotor 4 is immediately rotated at the same speed as the metal mold. With groove 18 filled with particulate material, and with member 6 in all events being slidably embraced by the rotor, the combination of member 6 and shaft 5 rotates with rotor 4. Rotation can be imparted initially to member 6 solely by the slidable engagement between surfaces 12 and 17, in which case initial rotation generates centrifugal force adequate to move the particulate material outwardly in groove 18 until that material is in forceful engagement with the portion of surface 12 which surrounds the groove, this action in effect frictionally connecting carrier member 6 to the rotor and assuring that member 6 rotates at essentially the same speed as mold 1**.

Figure 6:
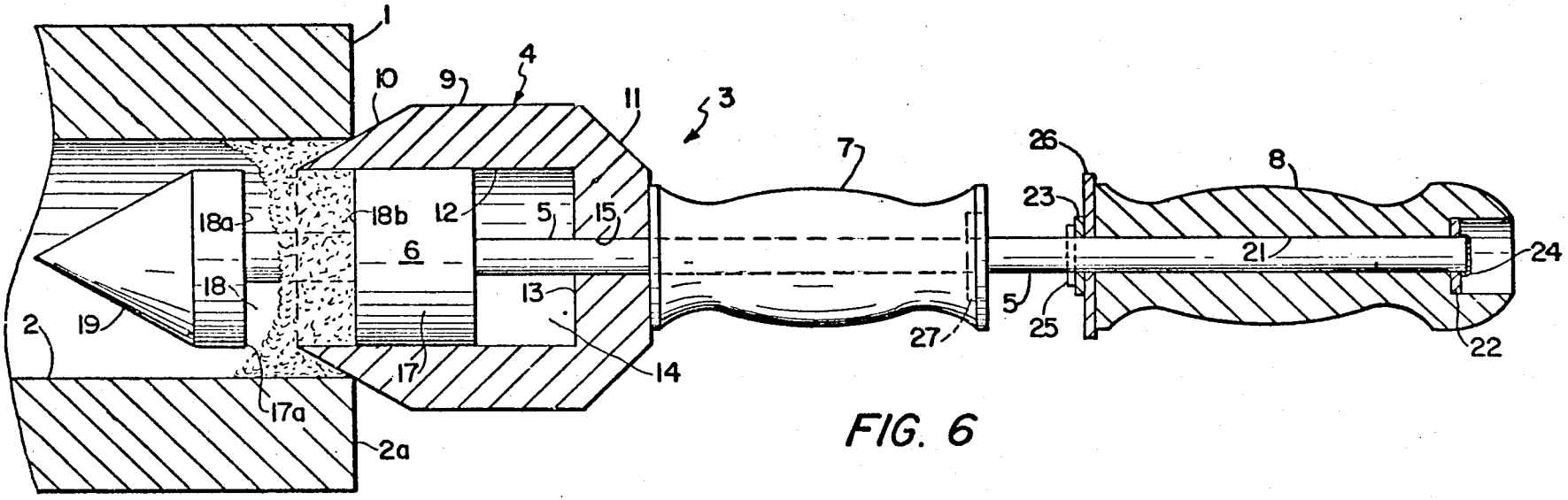
FIG. 6 is a view similar to FIG. 1 but showing the parts of the tool in relative position such that release of the particulate material has commenced.
Figure 7:
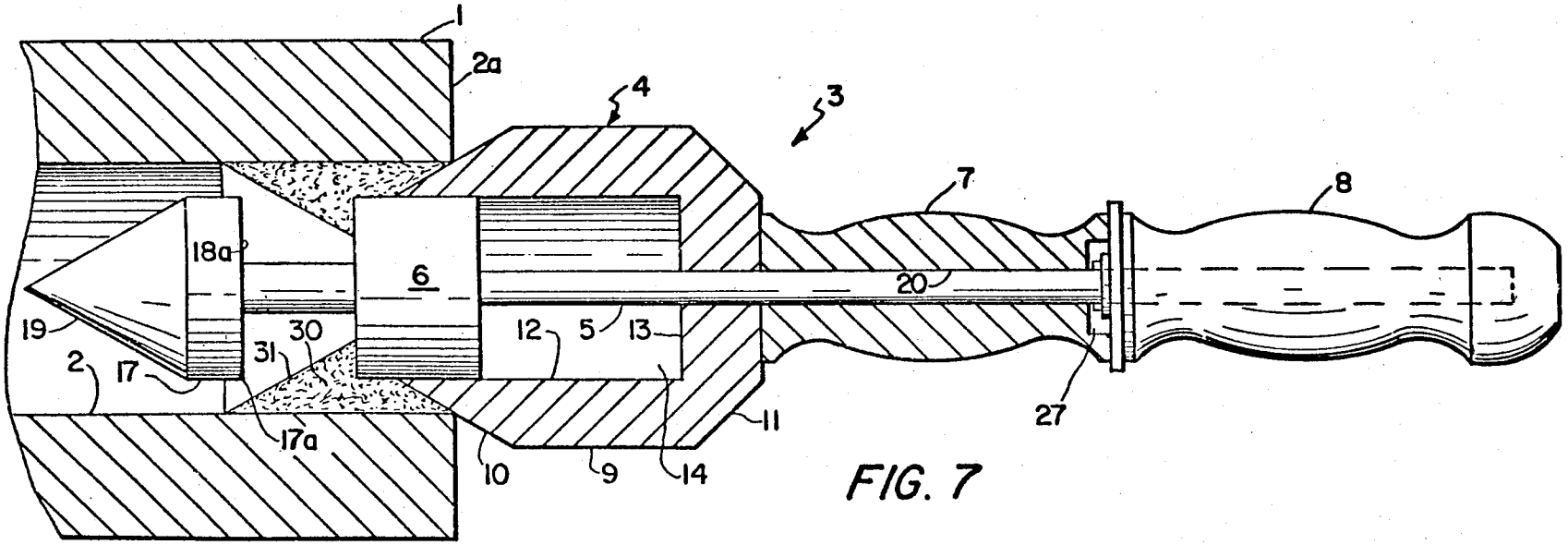
FIG. 7 is a view similar to FIG. 6 but showing parts in relative positions occupied when release of the particulate material has been completed.

With rotation of mold 1, and therefore rotor 4 and member 6, continuing, handle member 8 is manipulated to force shaft toward the interior of mold 1, overcoming the frictional engagement between the particulate material and surface 12 and causing member 6 to move progressively out of cavity 14 of the rotor so that groove 18 is progressively opened to the interior of the metal mold. Thus, as seen in FIG. 6, the side wall of groove 18 which is nearer tip 19 passes beyond the tip of surface 10, and the particulate material in the groove, expelled outwardly by centrifugal force, immediately begins escaping from the groove and traveling outwardly to engage active surface 2 of mold 1. The relative dimensions of cavity 14, member 6, shaft 5 and handle members 7,8 are such that handle member 8 does not engage handle member 7 until member 6 has traveled into mold 1 beyond that location necessary for escape of the particulate material. As the particulate material is projected centrifugally onto active surface 2 of the metal mold, the material escaping the groove begins to form ring 30, as illustrated in FIGS. 6 and 7, some of the material moving back toward the end of the mold to fill the space between surface 10 of the rotor and surface 2 of the metal mold, while some of the material spreads forwardly, so that ring 30 has a frustoconical face 31 which is directed inwardly of mold 1 and tapers inwardly toward tool 3 at an angle determined by the angle of repose of the particulate material. Advantageously, groove 18 initially contains more of the particulate material than is required for the ring, and face 31 of ring 30 therefore extends into groove 18 when carrier member 6 has been advanced to the final position seen in FIG. 7.

When the metal mold is heated prior to casting, the particulate material employed can be a conventional mixture of, e.g., silica sand and a small proportion of a dry particulate resin binder and, in that event, the metal mold, and therefore rotor 4 and carrier member 6 when tool 3 is fitted to the mold, can be rotated at relatively low rates, with the specific rate depending upon the diameter of active mold surface 2. It is most advantageous, however, to employ as the particulate material a binderless material, or mixture of materials, having the characteristics described above. When such a binderless material is employed, the mold is rotated at a rate which applies to the binderless refractory material a force providing an equivalent specific gravity of at least 7.5, determined in accordance with the formula $$\text{Eq. Sp. Gr.} = \text{Actual Sp. Gr.} \times G \quad (1)$$

where G is determined by the formula $$G = [(\text{RPM})^2 \times D]/70{,}400 \quad (2)$$

where D is the diameter of surface 32 of the ring. With mold 1 rotated at such a speed, the ring 30 is not only established as above described but also densified, so that an inner surface can be provided on the ring by contouring.

Figure 8:
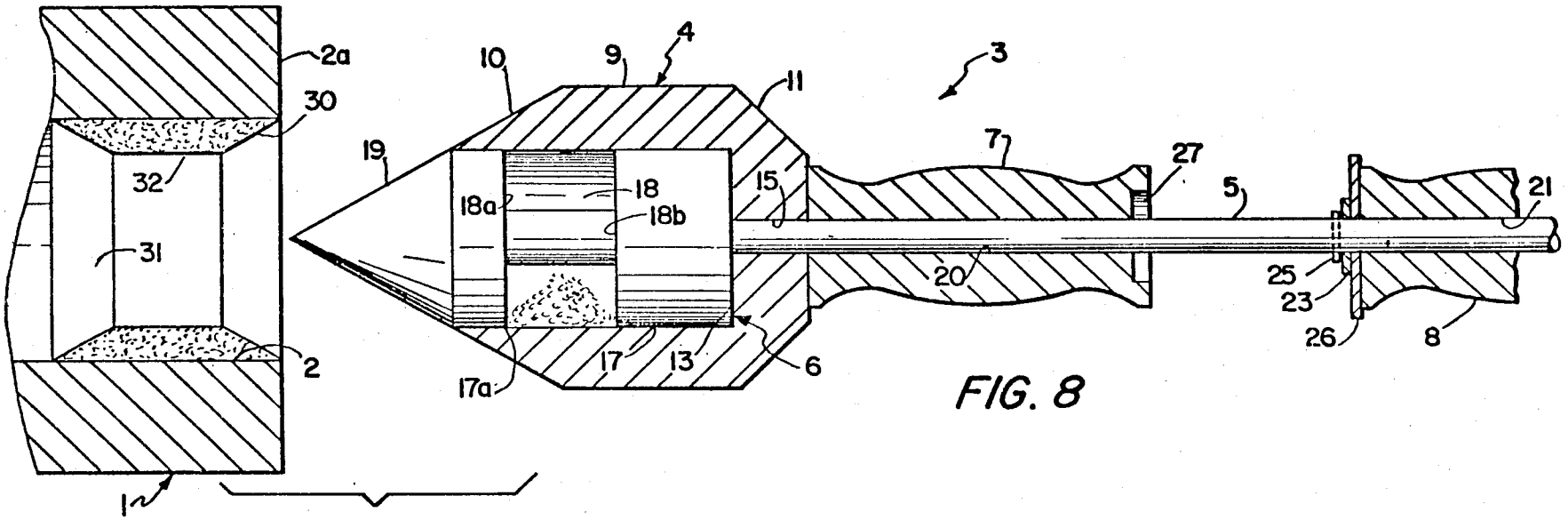
FIG. 8 is a view similar to FIG. 7 but showing the ring completed and the tool withdrawn from engagement with the mold.

Thus, when tool 3 has been manipulated to establish ring 30 and bring carrier member 6 to the position seen in FIG. 7, with rotation of the mold and the rotary parts of the tool continuing, handle member 8 is manipulated to draw member 6 back to its original position in cavity 14. As member 6 moves outwardly of mold 1, corner 17*a*, defined by sidewall 18*a* of groove 18 and the forward position of surface 17 as seen in FIG. 8, cuts through the excess material of the ring and contours the ring to provide a right circular cylindrical inner surface 32, the excess particulate material being retained in the groove. Such a contouring action cannot be achieved when the refractory material is a binderless particulate material unless the speed of rotation is adequate to densify the established ring. When a binderless refractory material is employed, the mold must continue to rotate at a rate adequate to provide an equivalent specific gravity of at least 7.5 until the molten metal to be cast has been introduced.

The refractory material can advantageously consist of any of the milled refractory materials, e.g., zircon flour, magnesium oxide, mullite flour, silica flour, dead-burned magnesite or equivalent or crushed graphite such as crushed used furnace electrodes. Mixtures of such materials with particulate refractory materials of a larger particle size, such as zircon sand and silica sand, can also be used, so long as the total mixture contains at least 20% by weight of particles which are angular, so that the mixture exhibits and angle of repose of at least 10°.

End rings established according to the method can be employed simply for retaining the molten metal in the mold, when the metal is to be cast directly against the metal mold, or in conjunction with a particulate refractory lining.

Tool Of FIGS. 9–11

FIGS. 9–11 illustrate one embodiment of a tool according to the invention for establishing one or a plurality of axially spaced rings within a metal mold when the ring or rings are to be internal rings rather than end rings. Such a tool is best used when the mold has already been provided with a preliminarily contoured refractory lining which includes annular gaps at the locations where the internal rings are to be established. Thus, metal mold 50 has an internal or active surface 51 and an end surface 52 and, as by following the teachings of U.S. Pat. 4,124,056, a lining 53 of finely particulate refractory material such as milled zircon flour or crushed graphite has been established, densified and preliminarily contoured so that the lining has a plurality of axially spaced annular gaps 54 in locations where, e.g., the article to be cast is to have outwardly projecting transverse annular flanges. At this stage, the lining is not yet contoured to final dimensions, surfaces 55 having an internal diameter slightly smaller than that required for the article to be cast, and only enough of the zircon flour or crushed graphite being left on surface 51 within gaps 54 to prevent the contouring tool from scoring the metal mold surface.

Tool 56 comprises a rotor 57 supported by external antifriction bearings 58 positioned and supported by a movable arm structure 59. Rotor 57 comprises a main rotor body 60 and an elongated tubular member 61. Body 60 has an annular front face including a forwardly and inwardly tapering frustoconical surface porton 62. Body 60 also has a right circular cylindrical outer surface portion 64, a rearwardly and inwardly tapering frustoconical surface portion 65, and a hub 66 embraced by bearings 58. Hub 66 is shouldered, as shown, to prevent relative axial movement between the hub and bearings but the arrangement is such that the bearings allow free rotation of body 60 relative to the arm structure 59. Internally, body 60 has a threaded bore 67 which opens through the forward end of the body, intersecting surface portion 62 and terminating in transverse surface 68. Surface portion 64 and bore 67 are coaxial and body 60 is rotationally balanced about the common axis. A through bore 69 extends through body 60, opening at one end through the end of hub 66 and at the other end through surface 68, and is coaxial with threaded bore 67. Rigidly fixed in threaded bore 67 is the externally threaded end portion of tubular member 61, the opposite end of member 61 being provided with a tip 70 dimensioned for insertion into and support by a bearing member 71 which is supported so that the bearing member will maintain the end of member 61 centered with respect to mold surface 51.

At each of a plurality of locations equal in number to and spaced apart the same as gaps 54, member 61 of the rotor is provided with a plurality of apertures 75 arranged in an annularly spaced series extending circumferentially relative to tubular member 61, the axial dimensions of the apertures being approximately equal to the width of that portion of the corresponding gap 54 which is only thinly covered with refractory material. In each annular series, apertures 75 are separated by uninterrupted portions 76 of the tubular wall of member 61. The arrangement is such that, when body 60 of the rotor is fitted to the end of mold 50 so that surface portion 62 engages the annular frustoconical corner between surfaces 51 and 52 of the mold, tip 70 of member 61 then being in engagement with bearing 71, each annular series of apertures 74 is disposed concentrically within the space defined by a different one of gaps 54.

In this embodiment, carrier member or spool 77 comprises a plurality of rigid members 78 each having a right circular cylindrical outer surface 70, members 78 being spaced apart axially and rigidly secured to an elongated shaft 80 in such fashion that each adjacent pair of members 78 cooperate with the corresponding portion of shaft 80 to define a transverse annular outwardly opening groove 81. The number of members 78 and the location of those members along shaft 80 are such that the number of grooves 81 equals the number of gaps 54. Shaft 80 extends (to the right as viewed) through bore 69, the free end of the shaft projecting beyond hub 66. Rectilinear actuation of shaft 80 to the right (as viewed) moves member 77 to a first position, in which the end of the carrier member engages surface 68 and each groove 81 is spaced from the corresponding gap 54 toward rotor body 60 by a distance greater than the axial dimension of the aperture 75. Member 77 is of a predetermined length, shorter than the distance between surface 68 and tip 70 of member 61 so that, when carrier member 77 is in its first position, its end opposite surface 68 is spaced from end wall **70*a* which supports tip 70. Actuation of shaft 80 to the left (as viewed) will move member 77 axially until the carrier member engages end wall 70*a*, each of the grooves 81 then being registered radially with a different one of the annular series of apertures 75 as seen in FIG. 9. Thus, a second position is established for the carrier member in which particulate material carried by grooves 81 can be centrifugally projected outwardly through apertures 75** onto the surrounding mold surface.

To allow particulate material to be introduced into the grooves 81, member 61 is provided with a plurality of filling openings 82 so position that, when member 77 is moved near its first position, each opening 82 registers with a different one of the grooves 81. Thus, with member 77 near its first position relative to rotor body 60, and with member 61 so located outside of mold 50 that all of filling openings 82 are directed upwardly, the tool is prepared for use by introducing the particulate material through openings 82 into grooves 81, then moving carrier member 77 axially toward its second position just far enough to shift grooves 81 out of registry with openings 82, so that the grooves are closed by the wall of member 61 and particulate material cannot escape from the grooves, as the tool is fitted to the mold and commences rotation, until member 77 is shifted axially to its second position.

Axial actuation of shaft 80 is accomplished by providing the shaft with an actuating hub 85 in a location spaced from hub 66 by a distance greater than that required to move carrier member 77 from its first position to its second position. Hub 85 is free for rotary movement relative to shaft 80 but is restrained against axial movement, as by shoulders 86,87. Cooperating with hub 85 is an actuating arm 88 having a bifurcated end portion 89 within which hub 85 is seated. Hub 85 has an elongated cylindrical outer surface terminating at each end in an end shoulder, the space between the end shoulders of the hub being such that, when actuating arm 88 is in a first position, portion 89 of the actuating arm engages end shoulder 90, and end shoulder 91 is spaced from the portion 89 by a distance such that the combination of carrier member 77 and shaft 80 can be moved manually, after grooves 81 have been supplplied with particulate material, to shift the carrier member just far enough away from surface 68 to have the grooves closed by the wall of member 61 rather than registering with openings 82. Arm 88 can be actuated rectilinearly in a direction parallel to the axis of rotation of the rotor by, e.g., a conventional lead screw mechanism or a convention fluid pressure operated piston-and-cylinder device (not shown). It will be understood that tool 56, bearings 58 and actuating arm 88 are advantageously carried by a movable support (not shown) constructed and arranged to support the tool in horizontal position for movement from a first, inactive location, in which member 61 is entirely withdrawn from mold 50, to a second position, in which member 61 extends through mold 50 and is engaged with and supported by bearing member 71 as seen in FIG. 9. The movable support can be rail-supported, as disclosed in U.S. Pat. No. 4,124,056.

Practice Of The Method With Tool Of FIGS. 9–11

To practice the method with the tool just described, mold 50 is advantageously first provided with a preliminary lining, such as a lining consisting of crushed graphite obtained by crushing used graphite furnace electrodes to a grain size suitable for the surface finish on the article to be cast, with establishment, densification and preliminary contouring carried out generally in accordance with U.S. Pat. No. 4,124,056. The preliminary lining includes relatively thicker portions of graphite which present right circular cylindrical inner surface portion 55, and gaps 54 in which the active surface 51 of the metal mold is covered by a film of graphite of minimum thickness. With tool 56 withdrawn from the metal mold, grooves 81 are filled with a particulate refractory material having desired characteristics different from those of crushed graphite. Thus, grooves 81 can be filled with milled zircon flour, the amount of zircon flour in each grove being predetermined by volume or weight to provide, when applied to the mold, a zircon layer substantially thinner than the layers presenting surfaces 55. When the particulate material has been introduced into grooves 81, tool 56 is then advanced toward mold 50 until member 61 has been inserted through the mold to bring tip 70 into engagement with bearing member 71 and surface 62 into engagement with the end of mold 50 as above described, such engagement causing rotor 57 to rotate at the same rate as mold 50 is rotating, i.e., a rate adequate to apply to the particulate material in grooves 70 centrifugal force causing the particulate material to have an equivalent specific gravity of at least 7.5, determined as hereinbefore explained. Actuating arm 88 is then operated to move shaft 80 to the left (as viewed) sufficiently to bring member 77 to its second position. Movement of member 77 to its second position brings each groove 81 into radial registry with the corresponding annular series of apertures 75, so that the particulate material in the groove is expelled outwardly, through apertures 75, into the gaps 54 and there establisehd as a densified layer. Tool 56 is then moved to the right (as viewed) until member 77 has been withdrawn completely from the mold, and the tool is displaced relative to the mold to allow free access to the mold cavity. Using a contouring device such as that disclosed in U.S. Pat. No. 4,124,056, and while still rotating mold 50 at a rate sufficient to densify all of the particulate material of the lining, the lining is then contoured to the final shape and dimensions desired for the article to be cast. Thus, both those portions of the lining which present surfaces 55 and those portions of the lining which have been established as rings in gaps 54 by use of tool 56 are contoured to final form such as that seen in FIG. 10. With mold 50 still being rotated at an appropriate rate for casting, the molten metal to be cast is then introduced and rotation continued until the molten metal has been distributed over the contoured lining and cooled to an adequate extent.

Use of graphite for the preliminary lining and zircon flour in gaps 54 is advantageous when, for example, the portion of the casting to be defined by surfaces 55 is to be quickly chilled, despite the necessary thickness of the lining in these areas, and the portions of the casting to be defined by the now-partially filled gaps 54 are to be especially smooth. The method can be used under other conditions. For example, when predetermined relatively short areas of the cast article are to have rough surfaces, as when those portions of the casting must be gripped during machining by an inflatable gripper, the material applied from grooves 81 can be zircon sand or silica sand, for example, of a relatively larger particle size than is the material employed for other portions of the lining. Similarly, when the action of a particulate reagent material, such as calcium/silicon, is desired over only selected portions of the casting, the reagent material can simply be applied as hereinbefore described for zircon flour, or a mixture of the reagent material with a finely particulate material, advantageously a milled refractory material such as zircon flour, silica flour, graphite, or the equivalent, can be employed, the mixture comprising 5–50% by weight of the milled refractory material and, correspondingly, 95–50% by weight of the particulate reagent material.

Use of the method and apparatus to introduce a particulate refractory material into gaps in a preliminary refractory lining as above described is advantageous in that it provides for precise constraint of the rings by the preliminary refractory lining. However, for purposes of economy, the method and apparatus can be employed to establish the rings on the active surface of the metal mold before the main portions of the lining are established, in which case the ends of the rings will be defined by action of the refractory material employed for the ring and thus will taper according to the angle of repose of that material.

Apparatus of FIGS. 13–15

FIGS. 13–15 illustrate an apparatus embodiment of the invention for full lining of a vertical centrifugal casting mold with, e.g., a binderless particulate refractory material. The conventional vertical centrifugal casting mold 100 is supported by a conventional mold rotating device 101 for rotating the mold about its vertical longitudinal axis. Spaced laterally from device 101 is an upright support 102 carrying a horizontal boom 103 of a length such as to cross above the mold position. The boom has a vertical opening accommodating a self-aligning bearing 104 which embraces and guides an upright rigid tube 105, the bearing serving to maintain tube 105 coaxial with the mold while allowing the tube to move upwardly and downwardly relative to the bearing.

At its lower end, tube 105 is welded to the upper end wall 107 of the outer member 108 of the cavity-defining device 109, member 108 having a right circular cylindrical outer wall 110 which is larger than but coaxial with tube 105. The upper end of tube 105 embraces and is rigidly secured to the upper end mount 111 of a rectilinear hydraulic power device 112, the tube being of larger diameter than but concentric with the cylinder 113 of the power device. Piston rod 114 of power device 112 extends through a sealed opening in lower member 107, which serves as the lower end wall of cylinder 113 and through the length of member 108, the piston rod being substantially longer than and coaxial with member 108. At its lower end, rod 114 has rigidly secured thereto a transverse circular end plate 115 which is a diameter such as to be capable of closing the open lower end of member 108. Rod 114 extends through plate 115, terminating in a downwardly directed conical point 116 adapted to be snugly received by an opening 117 of corresponding shape in the upper surface of the bottom of mold 100, when rod 114 has been moved downwardly to the position seen in FIG. 15. The upper face of plate 115 carries a conical baffle 118 which, as seen in FIG. 13, projects upwardly within member 108 when the periphery of plate 115 engages the lower end of member 108. In a location spaced above plate 115 by a distance significantly less than the length of member 108, an upper plate 119 is adjustably secured to rod 114 and lies in a plane parallel to plate 115, the diameter of plate 119 being such that the periphery of the plate slidably engages the inner surface of outer wall 110. The lower portion of rod 114 and plates 115 and 119 thus constitute a spool-like unit which combines with outer wall 110 to define a cavity for retaining the particulate material which is to form the layer on the active surface of mold 100.

Engagement of member 108 with mold 100, both to aid in centering the cavity-defining device relative to the mold and to impart rotation from the mold to member 108, is accomplished by three rollers 120 which are spaced equally around the opening in the end ring of the mold through which member 108 passes and are pivotally mounted on the end ring **100*a* in such fashion that, when pivoted downwardly and toward member 108, the rollers are forced into clamping engagment with member 108. Rollers 120 turn freely so that member 108** can be moved vertically relative to the mold at all times.

A vertical shaft 121 is secured to and projects upwardly from upper end mount 111 of power device 112.

Rotating with the combination of tube 105, power device 112 and cavity unit 109 when rollers 120 are clamped against member 108 and the mold is rotating, shaft 121 forms the inner rotary member of a dual swivel connector unit indicated generally at 122. Unit 122 includes two stationary connector members 123 and 124 each rigidly supported by a stationary bracket 125. Member 123 slidably embraces shaft 121 and has a radial bore 126 which communicates with an axial bore 127 in shaft 121 and with a hose 128. At its lower end, bore 127 communicates via a fitting 129 with a conduit 130 the lower end of which is connected by bore 131 with the space within cylinder 113 above piston **114*a* of power device 112. Member 124 slidably embraces an enlarged portion 132 of shaft 121 and has a radial bore 133 communicating between an axial bore 134 is shaft portion 132 and a hose 135. The lower end of bore 134 is connected by fitting 136 to a conduit 137 which is external until below upper end mount 111 and then passes downwardly through the space between tube 105 and cylinder 113, the lower end of conduit 137 communicating with the space below piston 114***a* via bore 138.

In order to hold the combination of members 105, 108 and cylinder 113 stationary when in the raised position seen in FIG. 13, a compressed air operated ring-type clutch 140 is mounted on the inner race of bearing 104 with its inflatable ring 141 surrounding tube 105. The inflatable ring of the clutch can be supplied with air under pressure via a supply hose 142 to inflate the ring into engagement with the outer surface of tube 105 and thus prevent tube 105, and therefore members 108 and 113, from moving relative to clutch 140. To release the clutch, thus allowing members 105, 108 and 113 to move vertically relative to the mold, ring 141 is vented to the atmosphere.

Near its upper end, outer wall 110 of member 108 is provided with lateral openings 145 any one of which can accommodate a filling tube 146 via which particulate material can be introduced into the cavity defined by plates 115 and 119 and wall 110. The hub of upper plate 119 slidably embraces rod 114 but, with rod 114 and lower plate 115 in the positions shown in solid lines in FIG. 13, plate 119 is fixed to wall 10 by one or more pins 147 inserted through openings in wall 110 under plate 119. With power device 112 having been operated to bring plate 119 into engagement with stops 149, carried by member 108, and with pins 147 inserted, plate 115 is held in the position shown in solid lines in FIG. 14, and filling of the cavity with particulate material via filling tube 146 can commence. It will be understood that, at this time, clutch 140 is in its energized condition, so that cavity-forming device 109 is locked in the position shown, and mold 100 is not rotating. At an appropriate time, pin 148 is removed, allowing rod 114, and therefore lower plate 115, to descend relative to plate 119 until plate 115 is immediately adjacent to, but just above, the lower end of member 108 as shown in broken lines in FIG. 13, pin 148 then being reinserted in rod 114. After the cavity defined by member 108 and end plates 115 and 119 have been filled with particulate material, pins 147 are removed and plate 119 is shifted downwardly until it occupies a position below filling openings 145, closing the now-filled cavity.

While filling has been described with the cavity aligned with the mold, as seen in FIG. 13, it will be understood that support 102 is rotatable about its vertical axis so that boom 113 can be swung to bring the cavity to a filling station spaced laterally from the mold.

Practicing The Method With The Apparatus of FIGS. 13–15

With the cavity defined by member 108 and the combination of plates 115 and 119 having been filled with a particulate material which is to form the lining on mold 100, and with boom 103 disposed to position piston rod 114 coaxially above the mold, clutch 140 is released to allow tube 105, and therefore cylinder 113, member 108 and piston rod 114, to descend by gravity into mold 100 until, with plate 115 still within the lower end portion of wall 110, tip 116 engages in recess 117 in the bottom wall of the mold. Rollers 120 are then pivoted downwardly and inwardly to clamp against the outer surface of wall 110 so that rotation of the mold is imparted to the combination of member 108, piston rod 114 and plates 115 and 119, tube 105 and power device 112. Pressure fluid is then supplied via hose 128, swivel fitting 123 and conduit 130 to the space in cylinder 113 above the piston, causing cylinder 113, and therefore tube 105 and member 108, to move upwardly out of the mold at a constant rate determined by the rate of pressure fluid supply while piston rod 114 and plates 115 and 119 remain in the positions seen in FIG. 15. As a result, the lower end of cylindrical wall 110 moves progressively upwardly away from plate 115, creating an annular opening via which particulate material can be projected outwardly, past the lower edge of wall 109, and projected by centrifugal force onto the active surface of mold 100. Since the mold and member 108 are rotating at the same speed, the escaping particulate material is also rotating at the same speed as the mold, and the particulate material is projected outwardly centrifugally, flowing radially over the lower edge of wall 110, and the particles come to rest on the inner surface of the mold without scattering. The thickness of the resulting layer of particulate material is determined by the quantity of particulate material in the cavity. When the rate of withdrawal of wall 110 from the mold is constant and is continued to cause the lower edge of the wall to traverse the entire length of the active surface of the mold, a continuous layer of constant thickness will be provided over the entire active surface of the mold. It will be apparent that multiple layers of the same or different particular materials can be established by repeating the method just described.

Contouring The Layer In a Vertical Mold

Once a layer of particulate material has been applied to the active surface of a vertical centrifugal casting mold in the manner just described, the layer can be contoured generally in the manner disclosed in my U.S. Pat. No. 4,124,056, as by using the tool disclosed in FIGS. 16 and 17, with the excess particulate material resulting from the contouring operation being carried away upwardly from the mold. The tool comprises a circular support plate 155 which includes a downwardly projecting central ball bearing point 156 received in the upwardly opening central recess in the bottom wall of mold 100. Near the periphery of plate 155, a vertical shaft 157 has its lower end welded to the plate, the upper end of shaft 157 being welded to a frame 158 spaced above the mold. The combination of support plate 155 and shaft 157 thus remains stationary while the mold is rotating. A straight tubular member 159 slidably embraces shaft 157 and extends axially along the inner surface of a generally tubular contouring member 160 and is welded thereto. The combination of member 159 and contouring member 160 is supported on plate 155 by a rotary bearing 161 so that the contouring member can be turned about the axis of shaft 157, as by a lever 162. Member 160 is of rigid sheet material and does not extend for a complete circle. Thus, generally diametrically across from shaft 157, member 160 is interrupted by a longitudinally extending gap 163 defined on one side by a simple edge 164 and on the other side by a contouring blade 165 which lies in a plane chordal with respect to the circumference of member 160. Blade 165 thus slants outwardly from the wall of member 165 and terminates in a cutting edge extending along a longitudinal line which is diametrically opposite and parallel to the axis of rotation established by shaft 157. The bottom of member 160 is closed by horizontal wall 166.

Since support plate 155 is centered on the bottom of the mold and shaft 157 is adjacent the periphery of wall 166, contouring blade 165 is eccentric with respect to the inner surface of mold 100. The tool is dimensioned to contour the layer 167 of particulate material to a desired thickness and, of course, the method hereinbefore described is carried out so that the initial thickness of layer 143 is greater than that desired. For contouring, the position of member 160 is rotationally adjusted until the cutting edge of blade 165 is in its position nearest to the inner surface of mold 100, i.e., to the position shown in solid lines in FIG. 17, while mold 100 is rotated continuously. As a result, the excess particulate material of layer 167 is shaved away by blade 165 and projected inwardly of member 160 through gap 163. As contouring proceeds, material shaved from upper portions of layer 167 falls through member 160 onto bottom wall 166. Adjacent member 159 and parallel thereto is an upright exhaust tube 168 fixed at its lower end to bottom wall 166 and having an opening 169 just above wall 166 for admission of particulate material. A first compressed air supply tube 170 extends downwardly beside the exhaust tube and has its lower end portion passing through an opening in the wall of the exhaust tube and bent upwardly at 171 to direct a high velocity flow of air upwardly through the exhaust tube and thereby induce flow of particulate material upwardly through the exhaust tube to a point of discharge (not shown) external to the mold. A second compressed air supply tube 172 extends downwardly beside shaft 157 and has its lower end portion 173 bent to lie in a plane at right angles to the shaft, portion 173 extending first semicircularly along the wall of member 160 and then, before reaching gap 163, curving inwardly of the contouring member so that its discharge end is directed generally from gap 163 toward opening 169 of exhaust tube 168. Thus, air discharged at a high velocity from the end of tube 173 induces particulate material to flow over bottom wall 166 from gap 163 toward the entrance opening 169 of the exhaust tube with the air flow continuing past the exhaust tube toward gap 163 in recirculating fashion as indicated by the arrows in FIG. 17. Thus the air from tube 172 sweeps across bottom wall 166 to carry the particulate material shaved from layer 167 by blade 165 to opening 169 of the exhaust tube while air from tube 170 carries the particulate material upwardly out of the mold via exhaust tube 168.

What is claimed is:

1. In apparatus for establishing a layer of particulate material on at least a portion of the active surface of a rotatable centrifugal casting mold, the combination of a hollow outer member having an outer surface and an inner surface, the dimensions and shapes of the outer surface being such that at least a portion of the outer member can be inserted axially into the mold;

an inner unit comprising first means capable of cooperating with the outer member to define cavity to accommodate the particulate material to be applied to the mold, and a shaft extending axially relative to said first means;

at least one of the outer member and the inner unit comprising means engageable with the mold to cause the apparatus to rotate with the mold;

the outer member and the inner unit being so constructed and interrelated that at least one of the outer member and the inner unit can be moved axially relative to the other in order to progressively open the cavity to allow radial release of particulate material held by the cavity when the mold and the apparatus are rotating; and means for accomplishing such relative axial movement while the mold and the apparatus are rotating.

2. The combination defined in claim 1, wherein the apparatus is operative to establish a ring of particulate material when the axial length of the ring is small in comparison to the axial dimension of the mold;

the outer member is a rotor and the outer surface thereof includes an axially directed portion shaped and dimensioned to be fitted against an end portion of the mold to locate the rotor relative to the mold and impart rotation from the mold to the rotor about an axis coincident with the axis of rotation of the mold, the rotor also having an elongated annular inner surface capable of cooperating with the inner unit to define the cavity, and a through bore centered on the axis of rotation of the rotor and through which the shaft of the inner unit extends;

the shaft has a first end portion adjacent the end of the cavity which leads as the rotor is inserted into the cavity, and a second end portion spaced axially from the rotor on the side opposite the cavity, the shaft being free for axial movement relative to the rotor;

the inner unit comprises a carrier member fixed to the first end portion of the shaft and having at least one outwardly opening recess within which particulate material can be disposed, the carrier member having an outer surface which is interrupted by the at least one outwardly opening recess and is slidably embraced by the annular inner surface of the rotor, the carrier member being movable axially relative to the rotor between a first position, in which the at least one outwardly opening recess is closed by the inner surface of the rotor, and a second position, in which the at least one outwardly opening recess is open for release of the particulate material; and the means for accomplishing relative movement of the outer member and the inner unit includes at least one manipulator carried by the shaft on the side of the rotor opposite the cavity and by which the shaft can be moved axially to shift the carrier member from its first position to its second position.

3. The combination defined in claim 2, wherein the rotor comprises a body member which includes said axially directed outer surface portion, said elongated annular inner surface, and a transverse portion located at the end of said elongated annular inner surface which is opposite said axially directed portion and through which the through bore extends.

4. The combination defined in claim 2, wherein the axially directed outer surface portion of the rotor is frustoconical and tapers inwardly and away from the body member, the frustoconical surface portion being of such dimension as to be engageably with the annular corner defined by an internal surface of the mold and an end surface of the mold.

5. The combination defined in claim 2, wherein
the elongated annular inner surface of the rotor is a right circular cylindrical surface; and
the outer surface of the carrier member is a right circular cylindrical surface.

6. The combination defined in claim 2, wherein
the at least one outwardly opening recess of the carrier member comprises a transverse annular outwardly opening groove.

7. The combination defined in claim 2, wherein
the tool is for establishing an end ring;
the at least one outwardly opening recess of the carrier member is a transverse annular groove; and
the relative axial dimensions of the carrier member and the elongated annular inner surface are such that, when the carrier member is in its first position, the elongated annular inner surface closes the groove in the carrier member.

8. The combination defined in claim 7, wherein
the axial dimension of the carrier member and the location of the groove relative to the length of the carrier member are such that a substantial portion of the length of the carrier member is still embraced by the elongated annular surface when the carrier member is in its second position.

9. The combination defined in claim 7, wherein
the carrier member includes a tip portion which projects away from the rotor body and it tapered to facilitate insertion of the carrier member into a mass of particulate refractory material to fill the groove when the carrier member is in its second position.

10. The combination defined in claim 2, wherein
the at least one manipulator comprises two handle members arranged end-to-end and slidably embracing the shaft,
the one of the handle members most distant from the rotor being restrained against axial movement relative to the shaft,
the shaft being free to move axially relative to the other of the handle members.

11. The combination defined in claim 2, wherein
the rotor comprises a tubular member projecting away from said axially directed portion in a direction such that, when said axially directed portion of the rotor is fitted against an end of the mold, the tubular member projects into the mold,
the inner surface of the tubular member constituting said elongated annular inner surface.

12. The combination defined in claim 11, wherein
the carrier member comprises an elongated member slidably embraced by the tubular member;
the tubular member of the rotor has at least one aperture spaced from the axially directed portion of the rotor by a predetermined distance; and
the carrier member has a transverse annular outwardly opening recess so located as to be closed by the tubular member when the carrier member is in a position other than its second position and to be radially aligned with said at least one aperture when the carrier member is in its second position.

13. The combination defined in claim 2, wherein
the elongated annular cavity-defining surface terminates within the mold when the axially directed portion of the rotor is fitted against an end of the mold;
the at least one outwardly opening recess of the carrier member includes a transverse annular outwardly directed groove.
the side wall of the groove most distant from the rotor intersecting the outer surface of the carrier member to define a sharp annular corner which is directed generally toward the rotor and which is exposed when the carrier member is in its second position,
the arrangement of the annular cavity defining surface, the carrier member and said sharp annular corner being such that, when more particulate material than is required for the ring to be established has been applied to the mold from the groove of the carrier member, axial withdrawal of the carrier member will cause said sharp annular shoulder to control the inner surface of the establisehd ring to cylindrical form of a predetermined diameter.

14. The combination defined in claim 1, wherein
the apparatus is operative to establish a continuous layer over at least a major portion of the length of the active surface of the mold;
the outer member is tubular, is longer than the active surface of the mold, and has an open end to be inserted into the mold;
the inner unit comprises two transverse plates carried by the shaft and dimensioned for slidable engagement with the inner surface of the outer member; and
the means for accomplishing relative axial movement between the outer member and the inner unit is constructed and arranged to move the outer member axially relative to the inner unit.

15. The combination defined in claim 14, wherein
the means for accomplishing relative axial movement between the outer member and the inner unit comprises a pressure fluid operated rectilinear motor having a cylinder and a piston rod,
the shaft of the inner unit constituting an extension of the piston rod.

16. The combination defined in claim 15, wherein
the apparatus is adapted to apply the layer to the active surface of a vertical centrifugal casting mold,
the shaft has an end adapted to engage the bottom of the mold; and
the tubular outer member is connected to the cylinder of the rectilinear motor,
the tubular outer member being movable relative to the inner unit by moving the cylinder of the rectilinear motor relative to the piston shaft.

17. The combination defined in claim 16 and further comprising
a tubular member surrounding the cylinder of the rectilinear motor and secured thereto; and
clutch means disposed above the mold and adapted to selectively engage said tubular member, to hold the cylinder of the rectilinear motor in an elevated position, and to release said tubular member, to allow the tubular member to move vertically with the cylinder of the rectilinear motor.

18. The method for establishing a layer of particulate material on at least a portion of the active surface of a rotatable centrifugal casting mold, comprising
confining a quantity of the particulate material in a closed cavity with the particulate material in such condition as to be projectable under centrifugal force;

rotating the mold at a rate adequate to densify the layer of said particulate material when a layer of that material has been established on the active surface of the mold;

introducing the cavity into the mold and rotating the cavity at substantially the same rate as the mold, that rate being adequate to apply a substantial centrifugal force to the particulate material confined in the activity;

while continuing to rotate the mold and cavity at such rates, progressively opening the cavity to release the particulate material centrifugally from the cavity with the centrifugal force then applying the released particulate material to the active surface of the mold in the form of a layer; and then withdrawing the cavity from the mold.

19. The method defined in claim 18, wherein the cavity is defined by an inner member having spaced walls, which form the ends of the cavity, and an outer member which embraces the walls;

the step of inserting the cavity into the mold is carried out to position the cavity so that the walls and the outer member are centered on the central axis of the mold; and the step of progressively opening the cavity is carried out by accomplishing relative axial movement between said inner and outer members.

20. The method according to claim 19, wherein said outer member has an end edge which becomes spaced from one of said walls when the step of accomplishing relative axial movement between said inner and outer members is carried out; and the particulate material flows outwardly over said end edge during release of the particulate material from the cavity.

21. The method according to claim 20, wherein the particulate material is applied to the active surface of the mold to form an end ring;

the step of introducing the cavity into the mold includes the step of placing a portion of said outer member in engagement with the mold; and the step of accomplishing relative movement between said inner and outer members is carried out by moving said inner member inwardly and axially of the mold while said outer member is held against axial movement because of engagement with the mold.

22. The method according to claim 19, wherein the particulate material is applied to the active surface of the mold to form a ring spaced from both ends of the mold;

said outer member has an annular series of apertures located where the ring to be formed when the cavity has been inserted into the mold and said apertures and closed by said inner member until the step of accomplishing relative axial movement between said inner and outer members is carried out.

23. The method according to claim 22 and further comprising first establishing on the active surface of the mold a preliminary lining of refractory material; and then establishing the ring in a predetermined location relative to the preliminary lining.

24. The method according to claim 18, wherein the method is carried out to apply the layer to a major portion of the length of the active surface of the mold; and the step of progressively opening the cavity to release the particulate material is accomplished by moving an outer tubular cavity-defining member axially relative to an inner cavity-defining member while holding the inner member against axial movement.

25. The method according to claim 19, wherein the method is carried out to apply the layer to the active surface of a vertical mold;

the cavity is inserted into the mold in such fashion that the inner member engages the bottom wall of the mold; and the step of progressively opening the cavity is carried out by withdrawing the outer member from the mold while holding the inner member in engagement with the bottom wall of the mold.

26. The method according to claim 18, wherein the cavity is defined by an inner member and an outer member;

the step of progressively opening the cavity is carried out by accomplishing relative axial movement between said inner and outer member;

the cavity is withdrawn from the mold after completion of the layer of particulate material; and then, with the mold still rotating, contouring the lining to final size and shape while conveying excess particulate material, dislodged from the layer by the contouring step, upwardly and out of the mold.

* * * * *

UNITED STATES PATENT AND TRADEMARK OFFICE

CERTIFICATE OF CORRECTION

PATENT NO. : 4,628,984

DATED : December 16, 1986

INVENTOR(S) : Charles H. Noble

It is certified that error appears in the above—identified patent and that said Letters Patent is hereby corrected as shown below:

Col 2 line 15 "a" should be -- an --

Col 2 line 46 "in" should be -- a --

Col 8 line 66 "establisehd" should be -- established --

Col 10 line 17 "which is a" should be -- which is of a --

Col 10 line 67 "is" should be -- in --

Col 11 line 43 "have" should be -- has --

Col 12 line 12 after "109, and" insert -- is --

Col 16 line 19 "control" should be -- contour --

Col 18 line 6 after "ring" insert -- is --

Col 18 line 8 "and" should be -- are --

Signed and Sealed this

Twenty-fourth Day of March, 1987

*Attest:*

DONALD J. QUIGG

*Attesting Officer* *Commissioner of Patents and Trademarks*